US008925525B2

(12) United States Patent
Wilms et al.

(10) Patent No.: US 8,925,525 B2
(45) Date of Patent: Jan. 6, 2015

(54) METHOD FOR OPERATING A FUEL INJECTION SYSTEM OF AN INTERNAL COMBUSTION ENGINE

(75) Inventors: Rainer Wilms, Markgroeningen (DE); Matthias Schumacher, Weissach (DE); Joerg Kuempel, Stuttgart (DE); Matthias Maess, Boeblingen (DE)

(73) Assignee: Robert Bosch GmbH, Stuttgart (DE)

( * ) Notice: Subject to any disclaimer, the term of this patent is extended or adjusted under 35 U.S.C. 154(b) by 297 days.

(21) Appl. No.: 13/139,273

(22) PCT Filed: Dec. 7, 2009

(86) PCT No.: PCT/EP2009/066523

§ 371 (c)(1),
(2), (4) Date: Aug. 22, 2011

(87) PCT Pub. No.: WO2010/066675

PCT Pub. Date: Jun. 17, 2010

(65) Prior Publication Data

US 2011/0295493 A1 Dec. 1, 2011

(30) Foreign Application Priority Data

Dec. 11, 2008 (DE) ..... 10 2008 054 513

(51) Int. Cl.
*F02M 51/00* (2006.01)
*F02D 41/20* (2006.01)

(Continued)

(52) U.S. Cl.
CPC ..... *F02D 41/20* (2013.01); *F02D 41/2467* (2013.01); *F02D 41/3845* (2013.01);

(Continued)

(58) Field of Classification Search
CPC ..... F02D 2041/2027; F02D 2200/0602; F02D 41/1402; F02D 41/20; F02D 41/2467; F02D 41/3845; F02M 59/366
USPC ..... 123/406.45, 480, 446, 445, 456, 496, 123/500, 486, 501; 701/103, 104
See application file for complete search history.

(56) References Cited

U.S. PATENT DOCUMENTS 4,213,181 A * 7/1980 Carp et al. ..... 701/115

(Continued)

FOREIGN PATENT DOCUMENTS

DE 101 48 218 4/2003
DE 102 35 196 2/2004

(Continued)

OTHER PUBLICATIONS

International Search Report for PCT/EP2009/066523 dated Feb. 19, 2010.

*Primary Examiner* — Erick Solis
*Assistant Examiner* — Carl Staubach
(74) *Attorney, Agent, or Firm* — Kenyon & Kenyon LLP

(57) ABSTRACT

A fuel injection system of an internal combustion engine delivers fuel into a fuel rail via a high-pressure pump. The quantity of the delivered fuel is influenced by a quantity control valve operated by an electromagnetic operating device. A trigger signal supplied to the electromagnetic operating device is defined by at least two parameters, and a) in an adaptation method with the second parameter defined, at least one first parameter of the trigger signal supplied to the electromagnetic operating device is varied successively up to a final value at which a closing or opening of the quantity control valve is at least indirectly no longer or just barely detected, b) the first parameter is subsequently defined at least temporarily based on the final value, and c) the temporarily defined first parameter is adapted based on at least one prevailing operating variable of the fuel injection system or the second parameter is adapted based on at least one prevailing operating variable of the fuel injection system and of the temporarily defined first parameter.

9 Claims, 7 Drawing Sheets

(51) Int. Cl.

| | |
|---|---|
| ***F02D 41/24*** | (2006.01) |
| ***F02D 41/38*** | (2006.01) |
| ***F02M 59/36*** | (2006.01) |
| *F02D 41/14* | (2006.01) |

(52) U.S. Cl.

CPC ..... *F02M 59/366* (2013.01); *F02D 41/1402* (2013.01); *F02D 2041/2027* (2013.01); *F02D 2200/0602* (2013.01)

USPC ..... 123/490; 361/154; 701/103; 123/456; 123/499

(56) References Cited

U.S. PATENT DOCUMENTS

| | | | | |
|---|---|---|---|---|
| 4,680,667 | A * | 7/1987 | Petrie | 361/154 |
| 4,922,878 | A * | 5/1990 | Shinogle et al. | 123/490 |
| 6,332,454 | B1 * | 12/2001 | Itabashi et al. | 123/490 |
| 7,559,311 | B2 * | 7/2009 | Tanaka | 123/458 |
| 7,738,233 | B2 * | 6/2010 | Frenz et al. | 361/153 |
| 8,280,611 | B2 * | 10/2012 | Forster et al. | 701/103 |
| 2005/0092301 | A1 | 5/2005 | Fukuda | |
| 2011/0288748 | A1 * | 11/2011 | Richter et al. | 701/103 |

FOREIGN PATENT DOCUMENTS

| | | |
|---|---|---|
| DE | 10 2006 001230 | 7/2006 |
| JP | 2005-23811 | 1/2005 |
| JP | 2005-291213 | 10/2005 |
| JP | 2005-330934 | 12/2005 |
| JP | 2008-215321 | 9/2008 |

* cited by examiner

METHOD FOR OPERATING A FUEL INJECTION SYSTEM OF AN INTERNAL COMBUSTION ENGINE

FIELD OF THE INVENTION

The present invention relates to a method for operating a fuel injection system of an internal combustion engine. The subject matter of the present invention is also a computer program and an electrical memory medium as well as a control and regulating unit.

BACKGROUND INFORMATION

German patent document DE 101 48 218 A1 discusses a method for operating a fuel injection system using a quantity control valve. The known quantity control valve is implemented as a solenoid valve which is operated electromagnetically by a solenoid and has a magnetic armature and corresponding path-limiting stops. The known solenoid valve is open in the energized state of the coil. However, such quantity control valves, which are closed in the currentless state of the solenoid, are also known from the market. In the latter case, the solenoid is triggered using a constant voltage or a clocked voltage (pulse width modulation, "PWM") to close the quantity control valve so that the current in the solenoid increases in a characteristic manner. After switching off the voltage the current drops again in a characteristic manner, so that the quantity control valve opens.

SUMMARY OF THE INVENTION

An object of the exemplary embodiments and/or exemplary methods of the present invention is to provide a method for operating a fuel injection system of an internal combustion engine in which what may be a low noise operation of the fuel injection system is achieved by using a simple arrangement.

This object is achieved by a method having the features of described herein. Advantageous refinements of the method according to the present invention are further characterized herein. Additional possible approaches are also described in the further descriptions herein. Features important for the present invention are also to be found in the following description and in the drawings, and these features may be essential to the present invention either alone or in various combinations without reference being made explicitly thereto.

When using the method according to the present invention, the impact speed of an operating element of the electromagnetic operating device against a stop is minimized, thereby reducing the operating noise of the quantity control valve. The basis for this is, on the one hand, an adaptation with which a parameter of a trigger signal of the electromagnetic operating device is optimized, in such a way that the operating element of the electromagnetic operating device is just moved into its end position under current feed but does so at an extremely low speed. This adaptation ultimately takes into account the fact that there are electromagnetic operating devices having different efficiencies, namely rapidly attracting, i.e., efficient systems as well as slowly attracting inefficient systems. Tolerance deviations from one quantity control valve to the other may also be taken into account in this way.

On the other hand, the exemplary embodiments and/or exemplary methods of the present invention is based on the fact that the prevailing operating variables of the fuel injection system are taken into account in the definition of the trigger signal of the electromagnetic operating device. This ensures that a trigger signal, which results in the lowest possible impact speed of the operating element against the stop, is used in very different operating situations using different operating variables of the fuel injection system accordingly.

In addition to reducing noise emissions, the scattering of noise, measured via a given random sample, is also minimized. Maintaining specified upper noise limits is therefore possible even more reliably, while reducing the risk of complaints about individual high-pressure pumps or quantity control valves. Reducing the impact speed also reduces the stress on the stops assigned to an operating element of the electromagnetic operating device. The corresponding load spectrum is therefore also reduced and the requirements on the mechanical parts of the quantity control valve with regard to wear and strength are decreased. The risk of failure due to wear is also reduced. Furthermore, the mentioned advantages may be achieved over the entire lifetime of the quantity control valve through this adaptation method. These advantages may be achieved without any significant additional cost because the present invention may be implemented through simple technical measures involving software without necessitating any additional components.

It is advantageous in particular if the two parameters belong to the following group: pulse duty cycle during a holding phase or an equivalent variable; duration of a pick-up pulse or an equivalent variable. Ultimately a type of noise minimum is thus sought for a very specific combination of pick-up pulse duration and pulse duty factor. Many of the electromagnetic operating devices customary today work with pulse width modulation (PWM), in which energy supplied to the electromagnetic operating device is set by a pulse duty factor. However, in the case of a current-controlled output stage, the parameter may also be a continuous current value. A "pick-up pulse" is understood to be a pulse-type current feed at the start of the trigger signal, with which the most rapid possible build-up of force acting on an armature of the electromagnetic operating device is to be achieved.

An important influencing variable on the force generated during triggering by the electromagnetic operating device is the so-called "cable harness resistance," among other things. This is the resistance of the feeder lines between the output stage and the electromagnetic operating device, for example, and contact resistances at contacts. This electrical resistance may change as a function of temperature and is also subject to comparatively great manufacturing tolerances and aging effects. Therefore, if the temperature of the fuel or a component of the fuel injection system or an equivalent variable is taken into account in adapting the parameters, the trigger signal is optimized in a particularly efficient manner. The voltage of a voltage source (of a vehicle battery, for example) to which the electromagnetic operating device is connected at least indirectly or an equivalent variable has a direct influence on the force exerted on the operating element of the electromagnetic operating device and thus on its speed. Taking this into account is therefore also very helpful in optimizing the trigger signal.

It is also advantageous in particular if, after step c), each of the two parameters not adapted in step c) is varied again in an adaptation method in a step d) successively from a starting value up to such a final value at which closing or opening of the quantity control valve is at least indirectly no longer or just barely detected and this parameter is subsequently established on the basis of the final value. According to the exemplary embodiments and/or exemplary methods of the present invention, a second adaptation is thus performed. This method thus offers a particularly good result and ensures that the speed of the operating element at the stop is in fact minimal over the entire lifetime of the device.

To achieve even better process results, steps c) and d) may be performed repeatedly in the sense of an iterative method.

To save on computation capacity, steps a) through c) or a) through d) may be performed only if the rotational speed of the internal combustion engine is below a limiting rotational speed. This takes into account the fact that the aforementioned noise problems generally occur only in idling and at rotational speeds of an internal combustion engine only slightly above idling because only in this rotational speed range is the operating noise of the internal combustion engine low enough for the impact noises of the operating element of the electromagnetic operating device to play any role at all.

The method according to the present invention results in a comparatively low speed of the operating element. Under some circumstances, this might result in the operating element reaching the stop at a very low impact speed but then rebounding because the magnetic force used is too low. This might result in an unwanted interruption in fuel supply. To prevent this, it is proposed according to the present invention that the electrical energy supplied to the electromagnetic operating device be increased at least approximately at the point in time when the operating element of the quantity control valve comes to rest against the stop.

Specific embodiments of the present invention are explained in greater detail below with reference to the accompanying drawings.

DETAILED DESCRIPTION

Figure 1:
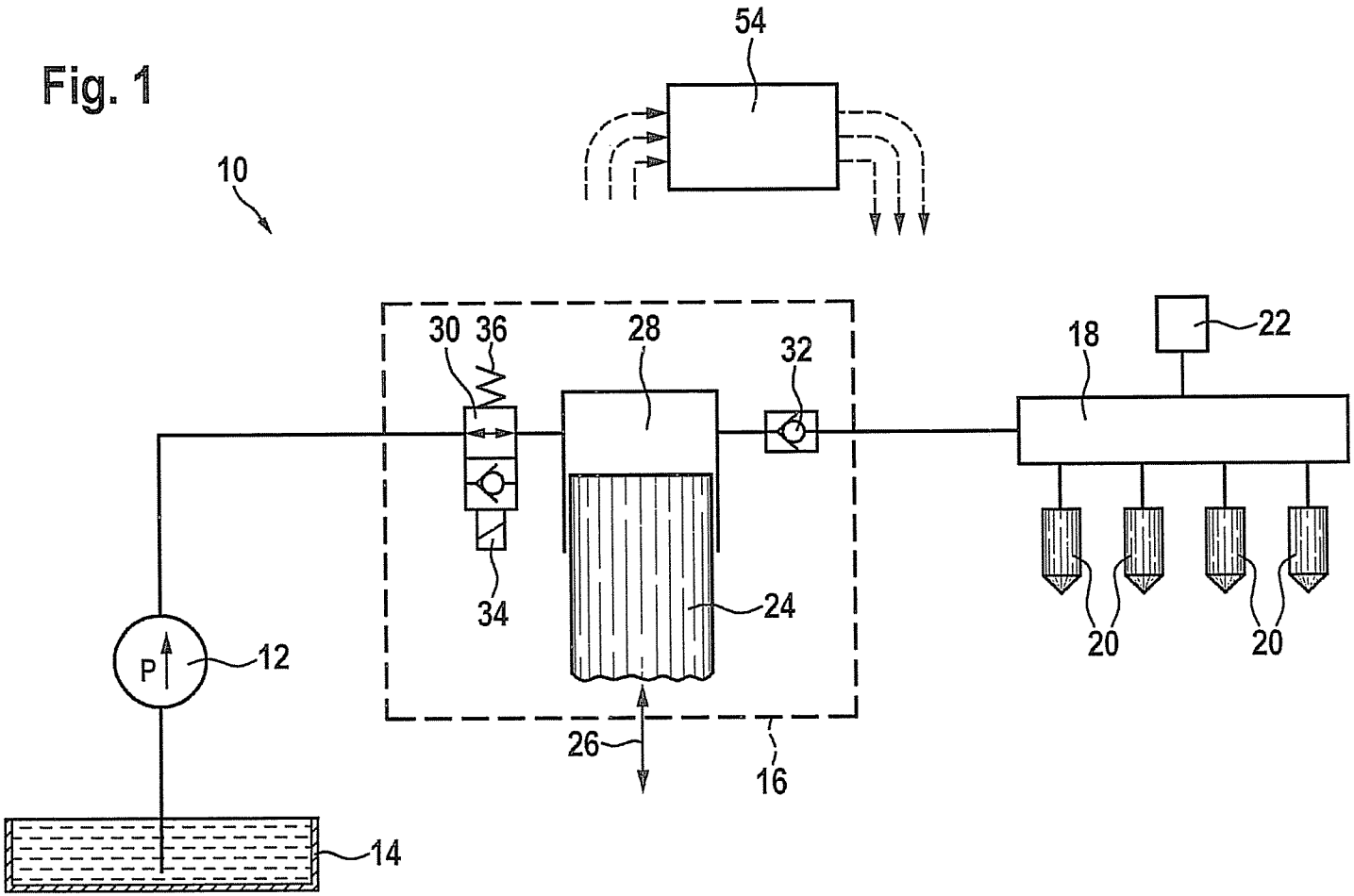
FIG. 1 shows a schematic diagram of a fuel injection system of an internal combustion engine having a high-pressure pump and a quantity control valve.

A fuel injection system in FIG. 1 is labeled overall using reference numeral 10. It includes an electrical fuel pump 12, using which fuel is delivered from a fuel tank 14 to a high-pressure pump 16. High-pressure pump 16 compresses the fuel to a very high pressure and delivers it further into a fuel rail 18. A plurality of injectors 20 is connected to this fuel rail, injecting fuel into combustion chambers assigned to the injectors. The pressure in fuel rail 18 is detected by a pressure sensor 22.

High-pressure pump 16 is a piston pump having a delivery piston 24, which may be induced to move back and forth (double arrow 26) by a camshaft (not shown). Delivery piston 24 delimits a delivery chamber 28 which may be connected via a quantity control valve 30 to the outlet of electrical fuel pump 12. Delivery chamber 28 may also be connected to fuel rail 18 via an outlet valve 32.

Figure 2:
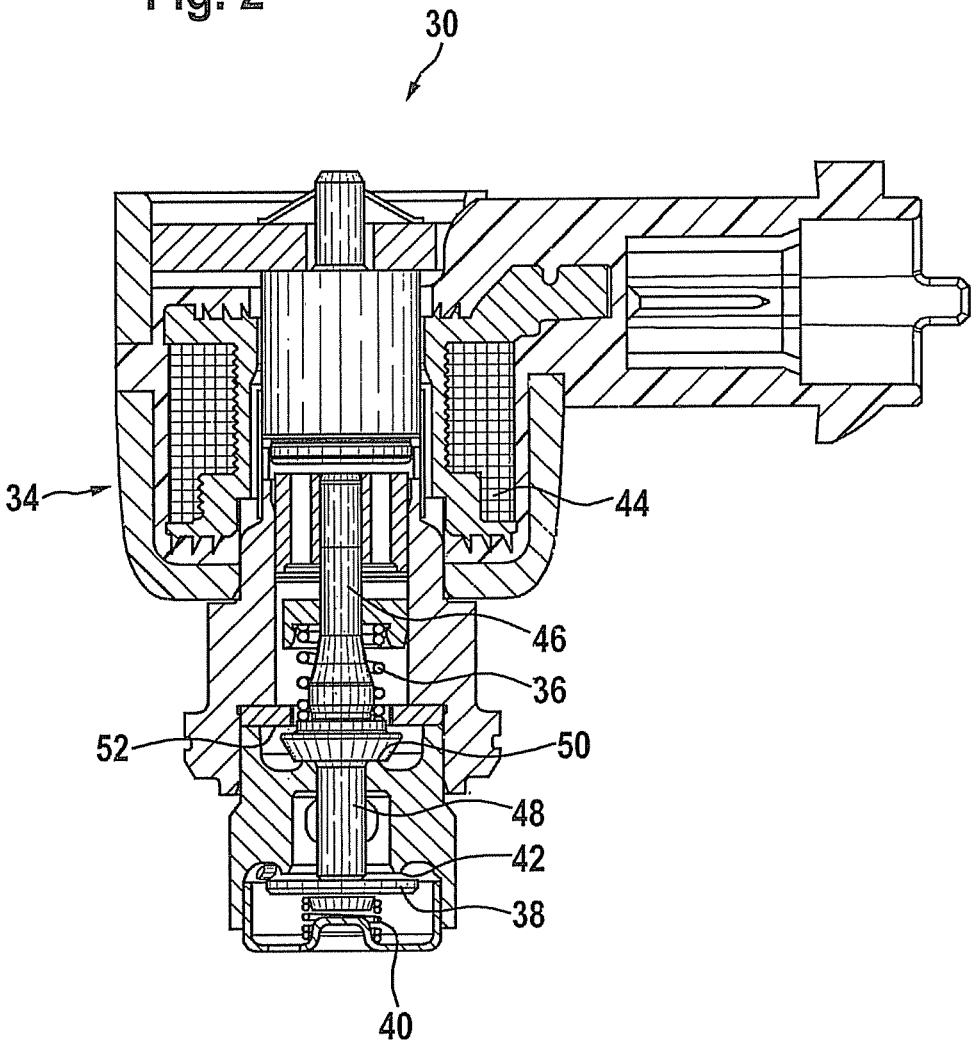
FIG. 2 shows a partial section through the quantity control valve of FIG. 1.

Quantity control valve 30 includes an electromagnetic operating device 34, which in the energized state operates against the force of a spring 36. Quantity control valve 30 is open in the currentless state; in the energized state, it has the function of a normal intake nonreturn valve. FIG. 2 shows the detailed design of quantity control valve 30.

Quantity control valve 30 includes a disk-shaped valve element 38, which is acted upon by a valve spring 40 against a valve seat 42. These three elements form the intake nonreturn valve mentioned above.

Electromagnetic operating device 34 includes a solenoid 44, which cooperates with an armature 46 of an actuating tappet 48. Spring 36 acts upon actuating tappet 48 against valve element 38 when solenoid 44 is currentless, forcing the valve element into its open position. The corresponding end position of actuating tappet 48 is defined by a first stop 50. When the solenoid is energized, actuating tappet 48 is moved away from valve element 38 against the force of spring 36 toward a second stop 52.

Figure 3:
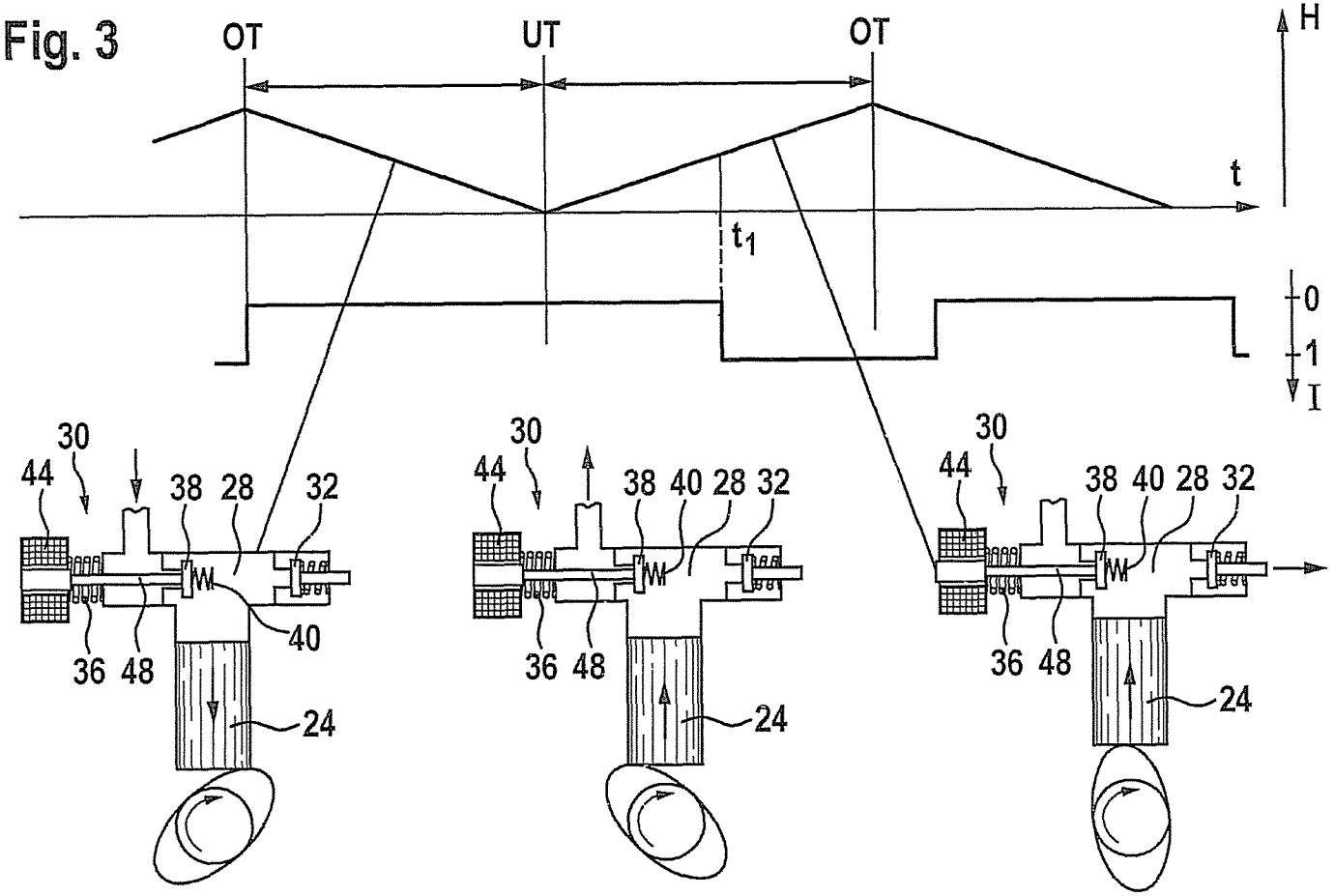
FIG. 3 shows a schematic diagram of various function states of the high-pressure pump and the quantity control valve of FIG. 1 having a corresponding time diagram.

High-pressure pump 16 and quantity control valve 30 operate as follows (see FIG. 3):

At the top of FIG. 3, a lift H of piston 24 is plotted as a function of time, and below that, the current feed I of solenoid 44 is plotted as a function of time t. Furthermore, high-pressure pump 16 is shown schematically in various operating states. During an intake stroke (left diagram in FIG. 3), solenoid 44 is currentless, so that actuating tappet 48 is forced by spring 36 against valve element 38, moving it into its open position. In this way, fuel may flow from electrical fuel pump 12 into delivery chamber 28. The delivery stroke of delivery piston 24 begins after reaching bottom dead center BDC. This is shown in the middle of FIG. 3. Solenoid 44 continues to be currentless, so that quantity control valve 30 is still forcibly open. Fuel is ejected by delivery piston 24 via opened quantity control valve 30 toward electrical fuel pump 12. Outlet valve 32 remains closed. There is no delivery into fuel rail 18.

The solenoid is energized at a point in time $t_1$, so that actuating tappet 48 is pulled away from valve element 38. At the end of the movement, actuating tappet 48 comes to rest against second stop 52 (FIG. 2). It should be pointed out here that the curve of the current feed of solenoid 44 is only shown schematically in FIG. 3. As will be explained further below, the actual coil current is not constant but is instead dropping due to mutual induction effects under some circumstances. In the case of a pulse-width-modulated trigger voltage, the coil current, moreover, is undulating or jagged.

Due to the pressure in delivery chamber 28, valve element 38 is in contact with valve seat 42; quantity control valve 30 is thus closed. Now a pressure is able to build up in delivery chamber 28, resulting in the opening of outlet valve 32 and delivery into fuel rail 18. This is shown at the far right of FIG. 3. Shortly after reaching top dead center TDC of delivery piston 24, the current feed of solenoid 44 is terminated, so that quantity control valve 30 again reaches its forcibly open position. The quantity of fuel delivered from high-pressure pump 16 to fuel rail 18 is influenced by varying point in time $t_1$. Point in time $t_1$ is established by a control and regulating device 54 (FIG. 1), in such a way that an actual pressure in fuel rail 18 corresponds to a setpoint pressure as accurately as possible. To this end, signals supplied by pressure sensor 22 are processed in control and regulating device 54.

Figure 4:
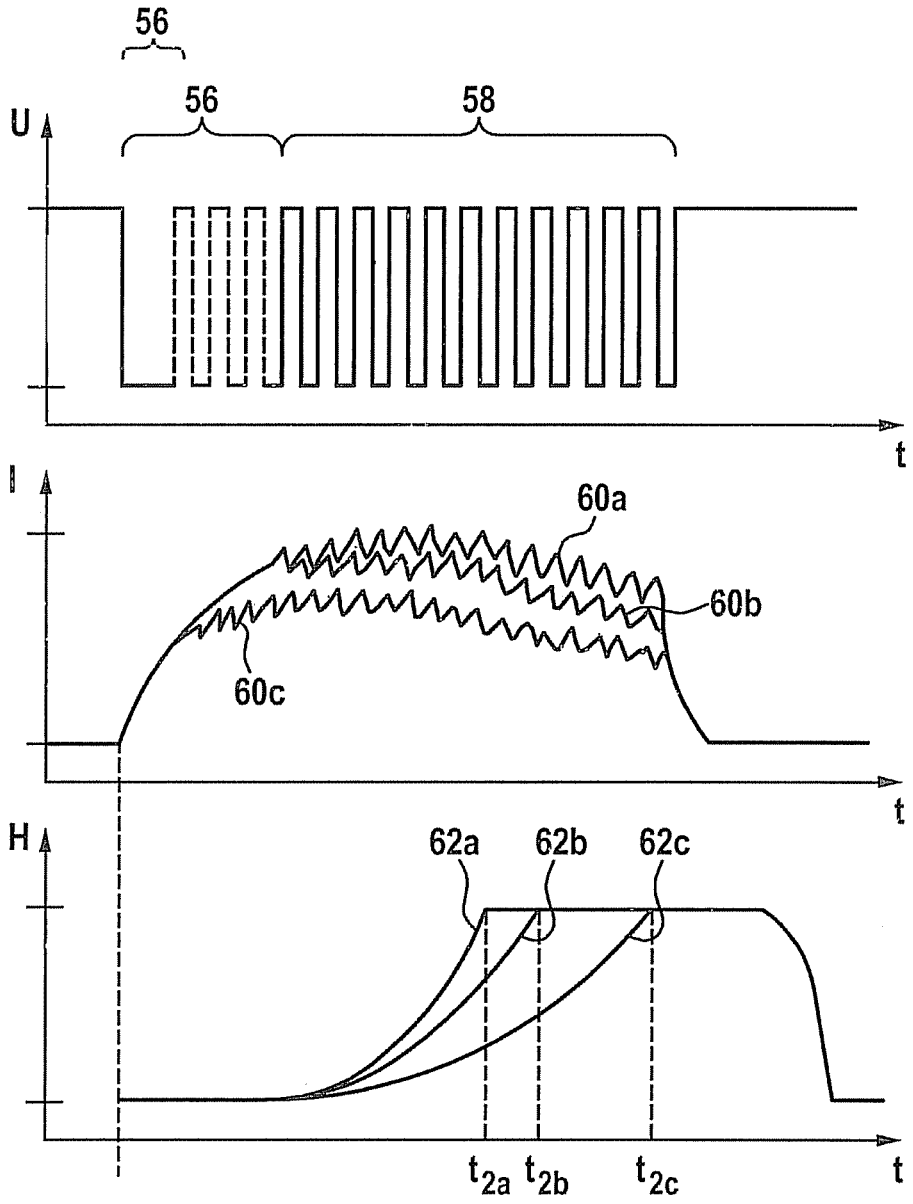
FIG. 4 shows three diagrams in which a trigger voltage, a current feed of a solenoid, and a lift of a valve element of the quantity control valve of FIG. 1 are plotted as a function of time, in performing a method for optimizing the trigger signal.

To reduce the impact noise of actuating tappet 48 when it comes to rest against second stop 52 when there is a current feed, in the present case a method is used for minimizing the speed at which actuating tappet 48 moves against second stop 52. This method includes initially a first adaptation method, which will now be explained with reference to FIG. 4:

FIG. 4 shows in the upper diagram the curve of a trigger voltage U, which is applied to magnetic coil 44 and is plotted as a function of time t. It is apparent here that this trigger voltage U is clocked in the sense of a pulse width modulation. The middle diagram in FIG. 4 shows the corresponding coil current I, the level of which is obtained from the pulse duty factor of voltage signal U. The lower diagram in FIG. 4 shows the corresponding lift H of actuating tappet 48 plotted as a function of time.

It is apparent from FIG. 4 that voltage signal U and coil current I resulting therefrom initially have a so-called "pick-up pulse" 56, which functions to build up the magnetic force acting on armature 46 as quickly as possible. Pick-up pulse 56 is followed by a holding phase 58, whose effective trigger voltage U is defined by the pulse duty factor of the pulse-width-modulated voltage signal. A coil current I, labeled with reference numeral 60*a* in FIG. 4, is obtained accordingly. Corresponding lift curve H is labeled as 62*a*. It is apparent here that due to the movement of actuating tappet 48 and of armature 46 coupled thereto, a mutual induction is generated in magnet coil 44, resulting in a reduction in effective coil current I in the present case. Curves 60*a* and 62*a* are valid for a first working cycle of high-pressure pump 16; one working cycle includes an intake stroke and a delivery stroke.

In the following working cycle, the pulse duty factor of the pulse-width-modulated voltage signal U during holding phase 58 is set in such a way that a lower effective current feed I of solenoid 44 is the result corresponding to a curve 60*b* in FIG. 4. Subsequently this yields a delayed movement of actuating tappet 48, corresponding to curve 62*b*. The pulse duty factor is now changed further successively so that effective coil current I drops further. In the case of a coil current I (not shown in FIG. 4), corresponding to a "limiting pulse duty factor," actuating tappet 48 is no longer moved adequately away from valve element 38; quantity control valve 30 thus remains open. Thus there is no delivery of fuel into the fuel rail. This in turn results in a great drop in pressure in fuel rail 18, i.e., a great and sudden deviation of the actual pressure in fuel rail 18 from the setpoint pressure, due to the fuel flowing out of fuel rail 18 via injectors 20, and this is detected by control and regulating device 54. Using this adaptation method, it is thus possible to ascertain the pulse duty factor at which quantity control valve 30 just no longer opens or just barely opens.

This limiting pulse duty factor, which may also be referred to as a "final value," is used to characterize the efficiency of electromagnetic operating device 34. A quantity control valve 30 having a rather efficient electromagnetic operating device 34 has a lower final value than a quantity control valve 30 having a rather inefficient electromagnetic operating device 34.

Pick-up pulse 56 is then adapted in another method step. For this purpose, a temperature of a component of the fuel injection system, ascertained by a sensor (not shown), as well as a voltage of a voltage source (for example, a vehicle battery, not shown), to which electromagnetic operating device 34 is connected, is fed into an engine characteristics map, which is used for a certain final value of the previously determined pulse duty factor ("standard pulse duty factor"). This yields a duration of pick-up pulse 56 for this specific pulse duty factor. If the final value of the pulse duty factor ascertained in the first adaptation differs from the standard pulse duty factor, this is taken into account using a corresponding correction factor. This yields an adapted duration of pick-up pulse 56. This is illustrated in the upper diagram in FIG. 4 by a dashed curve of voltage signal U and by a coil current I labeled with reference numeral 60*c* in the middle diagram in FIG. 4. This yields a corresponding lift curve 62*c*. The duration of pick-up pulse 56 and the pulse duty factor during holding phase 58 are thus optimized by the method presented here, in such a way that the impact speed of actuating tappet 48 against second stop 52 is minimal.

Figure 5:
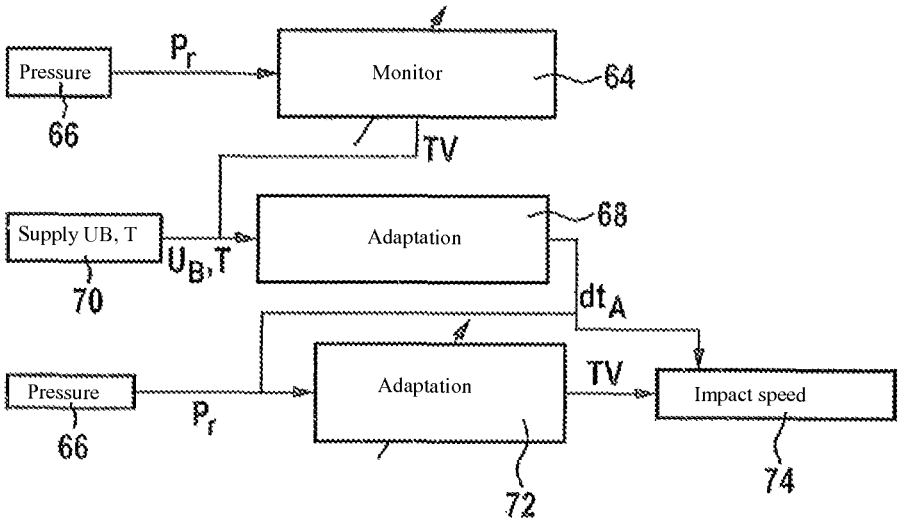
FIG. 5 shows a flow chart of a first specific embodiment of a method for operating the fuel injection system of FIG. 1.

For further optimization in the method presented here, the adaptation method mentioned and described above for optimization of the pulse duty factor is performed again during holding phase 58, i.e., now on the basis of the adapted duration of pick-up pulse 56. The method just described is shown in a flow chart in FIG. 5.

According to this, the first adaptation method is performed initially in 64 with monitoring of actual pressure Pr in fuel rail 18 in block 66. Subsequently in 68, duration $dt_A$ of pick-up pulse 56 is adapted as a function of temperature T, a voltage $U_B$ of a voltage source and pulse duty factor TV ascertained in 64, whereupon supply voltage $U_B$ of the voltage source and temperature T are supplied in 70. Using duration $dt_A$ of pick-up pulse 56 thereby obtained, a second adaptation of pulse duty factor TV is now performed in 72 with monitoring of system pressure Pr supplied in 66. The procedure in this adaptation in 72 is the same as that in 64 or as described further above in conjunction with FIG. 4. The particular parameter of trigger signal U or I, which was not adapted in preceding adaptation step 68 but instead functioned as an input variable there, is thus adapted in 72. An impact speed, which is minimal under the given boundary conditions, is obtained in 74.

An alternative specific embodiment of a method for optimizing the parameters of trigger signal U or I of electromagnetic operating device 34 will now be explained with reference to FIG. 6. It holds here as below that elements, areas, and function blocks having functions equivalent to those of elements, areas, and function blocks already explained in conjunction with the preceding figures have the same reference numerals and will not be described again in detail.

Figure 6:
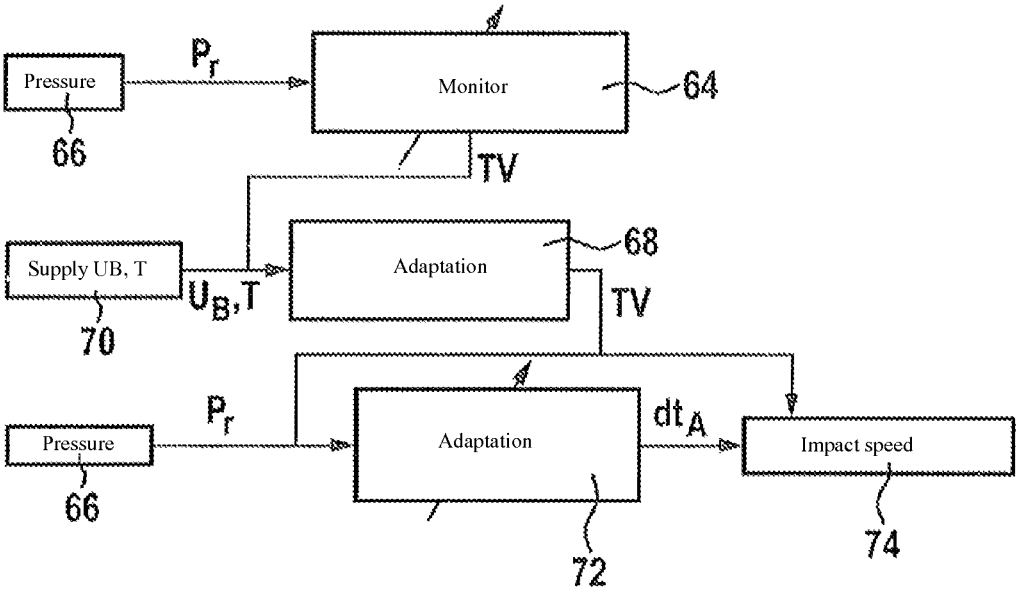
FIG. 6 shows a flow chart similar to that in FIG. 5 of a second specific embodiment.

In the method illustrated in FIG. 6, the input and output variables of the two function blocks 68 and 72 are switched. This means that in block 68, pulse duty factor TV is adapted in holding phase 58, taking into account temperature T and supply voltage $U_B$, and this adapted pulse duty factor TV is then fed into adaptation block 72, where duration $dt_A$ of pick-up pulse 56 is adapted. For this purpose, duration $dt_A$ of pick-up pulse 56 is varied successively, i.e., from one working cycle to the next working cycle up to such a final value at which closing of quantity control valve 30 by monitoring of pressure $P_r$ in the fuel rail in block 66 is no longer detected. On the basis of this final value, duration $dt_A$ of pick-up pulse 56 is then defined, for example, based on the final value plus a safety margin. By using pulse duty factor TV adapted in 68 and duration $dt_A$ of pick-up pulse 56 adapted in 72, trigger signal U of the electromagnetic operating device is defined in such a way that a minimal noise during the attraction of armature 46 and the resulting impact of actuating tappet 48 against second stop 52 is achieved.

Figure 7:
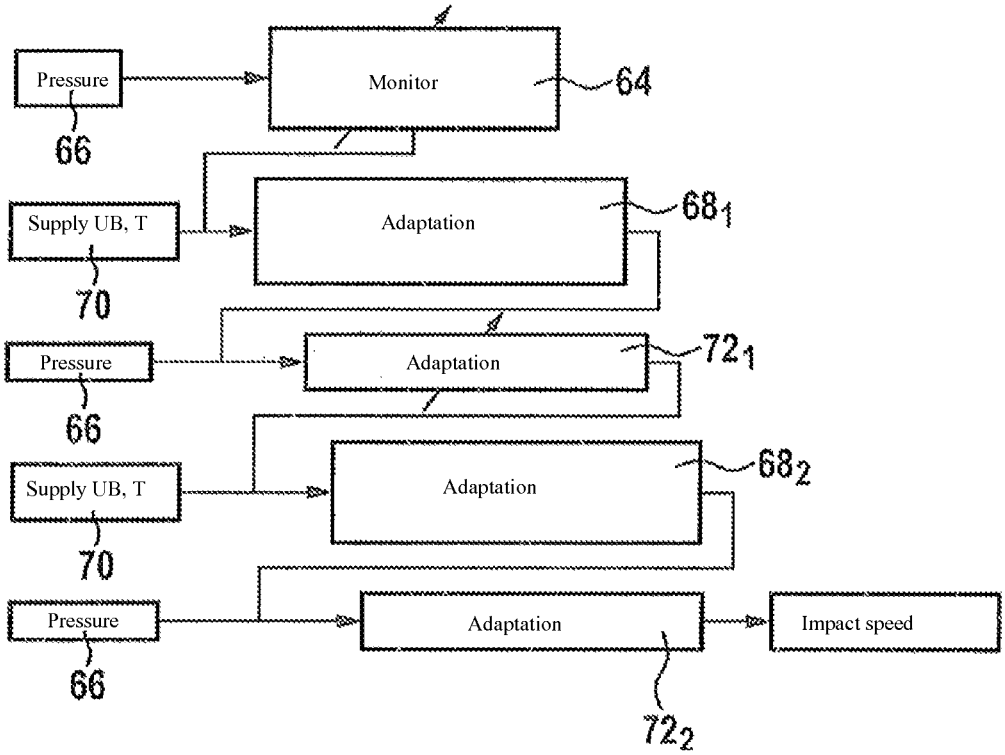
FIG. 7 shows a flow chart similar to that in FIG. 5 of a third specific embodiment.

Yet another alternative specific embodiment is shown in FIG. 7. This differs from the specific embodiments of FIGS. 5 and 6 in that steps 68 and 72 are performed repeatedly in alternation in the sense of an iterative process. An adaptation in a block $\mathbf{68}_i$, where i=1, 2, 3, . . . is thus always performed in alternation with an adaptation $\mathbf{72}_i$, where i=1, 2, 3, . . . . If the duration of pick-up pulse 56 is adapted in $\mathbf{68}_i$, the pulse duty factor is adjusted in $\mathbf{72}_i$. However, if the pulse duty factor is adjusted in $\mathbf{68}_i$, then adaptation of the duration of pick-up pulse 56 is performed in $72_i$. The iteration may be terminated when the changes in the pulse duty factor or the duration of pick-up pulse 56 have dropped below a certain measure. Other convergence criteria may also be considered. They may be calculated from preceding adaptation results and/or known performance data.

The method steps described above in conjunction with FIGS. 5 through 7 are implemented in control and regulating unit 54 in such a way that they are not performed above a certain rotational speed of a crankshaft of the internal combustion engine or a drive shaft of high-pressure pump 16. The mentioned method steps are advantageously performed only in an operation of the internal combustion engine in which the rotational speed is comparatively low, for example, in the idling range.

Through the above-mentioned adaptations in 64 and 72, comparatively low pulse duty factors are implemented during holding phase 58. In the absence of countermeasures, this could result in actuating tappet 48 coming to rest against second stop 52, but doing so at such a low speed that it rebounds due to the very low magnetic force. In such a case, quantity control valve 30 would not close, so high-pressure pump 16 would not deliver. To prevent this fault, in the present method the pulse duty factor is increased during holding phase 58 at a point in time of the contact of actuating tappet 48 with second stop 52, this point in time having been calculated in advance (point in time $t_2$ in FIG. 4) so that the force acting on armature 46 is increased and actuating tappet 48 is prevented from rebounding from second stop 52. The pulse duty factor of pulse-width-modulated voltage signal U is thus switched during holding phase 58.

What is claimed is:

1. A method for operating a fuel injection system of an internal combustion engine, in which fuel is delivered by a high-pressure pump into a fuel rail and in which a quantity of the delivered fuel is influenced by a quantity control valve operated by an electromagnetic operating device, a trigger signal supplied to the electromagnetic operating device being defined by at least two parameters, the method comprising:

in a preliminary adapting step, varying at least one first parameter of the at least two parameters, which is supplied to the electromagnetic operating device, from a respective starting value successively up to a respective final value at which a closing or opening of the quantity control valve transitions from being fully detected to no longer or just barely detected, wherein (a) a second parameter of the at least two parameters is defined prior to the varying, (b) the first parameter and the second parameter can be varied without influencing each other, and (c) the second parameter is fixed as defined prior to the varying for a duration of the varying of the first parameter;

subsequently defining the first parameter at least temporarily based on the final value to provide a temporarily defined first parameter;

in a first adapting step performed after the preliminary adapting step, one of adapting (i) the temporarily defined first parameter based on at least one prevailing operating variable of the fuel injection system, and (ii) the second parameter based on at least one prevailing operating variable of the fuel injection system and the temporarily defined first parameter; and for whichever of the temporarily defined first parameter and the second parameter that was not adapted in the first adapting step:

in a second adapting step performed after the first adapting step, varying the respective parameter from a respective starting value successively up to a respective final value at which the closing or opening of the quantity control valve transitions from being fully detected to no longer or just barely detected, wherein the parameter that was adapted in the first adapting step is fixedly defined based on a final value of the first adapting step, for a duration of the varying of the respective parameter; and subsequently defining the respective parameter based on the final value of the second adapting step.

2. The method of claim 1, wherein the first parameter is a pulse duty factor during a holding phase or a corresponding variable thereof, and the second parameter is a duration of a pick-up pulse or a corresponding variable thereof, and wherein the pick-up pulse precedes the holding phase in each of the preliminary, the first and the second adapting steps.

3. The method of claim 1, wherein the prevailing operating variable is one of (i) a temperature of the fuel or a component of the fuel injection system or a corresponding variable, and (ii) a voltage of a voltage source, to which the electromagnetic operating device is connected at least indirectly or a corresponding variable.

4. The method of claim 1, wherein both adaptings are performed repeatedly in an iterative manner.

5. The method of claim 1, wherein the varying, the defining, and the adapting are performed only if a rotational speed of the internal combustion engine is below a limiting rotational speed.

6. The method of claim 1, wherein the electrical energy supplied to the electromagnetic operating device is increased at least approximately at that point in time when an operating element of the quantity control valve comes to rest against a stop.

7. A non-transitory computer readable medium on which is stored instructions that are executable by a processor, the instructions which, when executed by the processor, cause the processor to perform a method for operating a fuel injection system of an internal combustion engine, in which fuel is delivered by a high-pressure pump into a fuel rail and in which a quantity of the delivered fuel is influenced by a quantity control valve operated by an electromagnetic operating device, a trigger signal supplied to the electromagnetic operating device being defined by at least two parameters, the method comprising:

in a preliminary adapting step, varying at least one first parameter of the at least two parameters, which is supplied to the electromagnetic operating device, from a respective starting value successively up to a respective final value at which a closing or opening of the quantity control valve transitions from being fully detected to no longer or just barely detected, wherein (a) a second parameter of the at least two parameters is defined prior to the varying, (b) the first parameter and the second parameter can be varied without influencing each other, and (c) the second parameter is fixed as defined prior to the varying for a duration of the varying of the first parameter;

subsequently defining the first parameter at least temporarily based on the final value to provide a temporarily defined first parameter;

in a first adapting step performed after the preliminary adapting step, one of adapting (i) the temporarily defined first parameter based on at least one prevailing operating variable of the fuel injection system, and (ii) the second parameter based on at least one prevailing operating variable of the fuel injection system and the temporarily defined first parameter; and for whichever of the temporarily defined first parameter and the second parameter that was not adapted in the first adapting step:

in a second adapting step performed after the first adapting step, varying the respective parameter from a respective starting value successively up to a respective final value at which the closing or opening of the quantity control valve transitions from being fully detected to no longer or just barely detected, wherein the parameter that was adapted in the first adapting step is fixedly defined based on a final value of the first adapting step, for a duration of the varying of the respective parameter; and subsequently defining the respective parameter based on the final value of the second adapting step.

8. The non-transitory computer readable medium of claim 7, wherein the method further includes applying the trigger signal in accordance with the first parameter as defined by the first adapting step, and in accordance with the second parameter as defined by the second adapting step.

9. The method of claim 1, further comprising applying the trigger signal in accordance with the first parameter as defined by the first adapting step, and in accordance with the second parameter as defined by the second adapting step.

* * * * *